US005437803A

United States Patent [19]

Cane et al.

[11] Patent Number: 5,437,803

[45] Date of Patent: * Aug. 1, 1995

[54] PROCESS FOR THE PRODUCTION OF A LUBRICATING OIL ADDITIVE CONCENTRATE

[75] Inventors: Charles Cane, Hull; John Crawford, Surrey; Patrick S. O'Connor, Hull, all of England

[73] Assignee: BP Chemicals (Additives) Limited, London, England

[ * ] Notice: The portion of the term of this patent subsequent to Nov. 10, 2009 has been disclaimed.

[21] Appl. No.: 96,061

[22] Filed: Jul. 22, 1993

Related U.S. Application Data

[63] Continuation of Ser. No. 713,532, Jun. 5, 1991, abandoned, which is a continuation of Ser. No. 363,550, Jun. 8, 1989, abandoned.

[30] Foreign Application Priority Data

Jun. 14, 1988 [GB] United Kingdom ..... 14010

[51] Int. Cl.[6] ..... C10M 159/12

[52] U.S. Cl. ..... 252/33.2; 252/39; 252/42.7

[58] Field of Search ..... 252/33.2, 39, 42.7

[56] References Cited

U.S. PATENT DOCUMENTS

| | | | |
|---|---|---|---|
| 3,055,828 | 9/1962 | Wiley . | |
| 3,256,186 | 6/1966 | Greenwald | 252/33 |
| 3,372,116 | 3/1968 | Meinhardt | 252/36 |
| 3,410,801 | 11/1968 | Tunkel et al. | 252/33 |
| 3,493,516 | 2/1970 | Allphin et al. | 252/39 |
| 3,535,242 | 10/1970 | Hashimoto et al. | 252/33 |
| 3,539,511 | 10/1970 | Sabol et al. | 252/33 |
| 3,544,463 | 12/1970 | Koft | 252/33 |
| 3,629,109 | 12/1971 | Gergel et al. | 252/39 |
| 3,658,703 | 4/1972 | Gragson et al. | 252/33 |
| 3,671,430 | 6/1972 | Corringer | 252/33 |
| 3,766,066 | 10/1973 | McMillen | 252/33 |
| 3,857,790 | 12/1974 | Saunders et al. | 252/33 |
| 4,328,111 | 5/1982 | Watson et al. | 252/33.4 |
| 4,698,170 | 10/1987 | Le Coent | 252/33.2 |
| 4,744,921 | 5/1988 | Liston | 252/427 |
| 4,764,295 | 8/1988 | Le Coent | 252/33.2 |
| 4,824,585 | 4/1989 | Marotel et al. . | |
| 5,069,804 | 12/1991 | Marsh et al. | 252/56 R |
| 5,162,085 | 11/1992 | Cane et al. | 252/39 |
| 5,330,665 | 7/1994 | Cane et al. | 252/42.7 |

FOREIGN PATENT DOCUMENTS

| | | | |
|---|---|---|---|
| 0013808 | 8/1980 | European Pat. Off. . | |
| 0095322 | 11/1983 | European Pat. Off. | C10M 159/22 |
| 0300486 | 1/1989 | European Pat. Off. . | |
| 1037241 | 7/1966 | United Kingdom . | |
| 1154370 | 6/1969 | United Kingdom . | |
| 2037801 | 7/1980 | United Kingdom . | |
| WO88/03944 | 6/1988 | WIPO . | |
| WO88/03945 | 6/1988 | WIPO . | |

*Primary Examiner*—Jerry D. Johnson

*Attorney, Agent, or Firm*—Brooks Haidt Haffner & Delahunty

[57] ABSTRACT

A process for the production of a lubricating oil additive concentrate which process comprises reacting at elevated temperature component (A) a defined acid or derivative thereof, component (B) a calcium base added either in a single addition or in a plurality of additions at intermediate points during the reaction, component (C) at least one compound which is (i) water, (ii) a polyhydric alcohol having 2 to 4 carbon atoms, (iii) a di- ($C_3$ or $C_4$) glycol, (iv) a tri ($C_2$–$C_4$) glycol, (v) a mono- or poly-alkylene glycol alkyl ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, component (D) a lubricating oil, component (E) a defined carboxylic acid or derivative in an amount up to 60% by weight of the total weight of component (A) and component (E), said total weight of component (A) and component (E) being that required to satisfy an equivalent ratio of component (B) to component (A) plus component (E) of not greater than one.

4 Claims, No Drawings

PROCESS FOR THE PRODUCTION OF A LUBRICATING OIL ADDITIVE CONCENTRATE

This application is a continuation of application Ser. No. 07/713,532, filed Jun. 5, 1991, now abandoned, which is a continuation of Ser. No. 07/363,550, now abandoned filed Jun. 8, 1989.

The present invention relates to a process for the production of, and compositions comprising, lubricating oil additive concentrates containing alkaline earth metal hydrocarbyl-substituted salts of acids and their sulphurised derivatives.

In the internal combustion engine, by-products from the combustion chamber often blow by the piston and admix with the lubricating oil. Many of these by-products form acidic materials within the lubricating oil.

Compounds generally employed to neutralise the acidic materials and disperse sludge within the lubricating oil are the metal hydrocarbyl-substituted phenates, salicylates, naphthenates and sulphonates and sulphurised derivatives thereof, wherein the metal is an alkaline earth metal such as calcium, magnesium, barium or strontium. Both normal, low based and overbased alkaline earth metal hydrocarbyl-substituted phenates, salicylates, naphthenates and sulphonates and sulphurised derivatives thereof, have been employed. The term "overbased" is used to describe those alkaline earth metal hydrocarbyl-substituted salts in which the ratio of the number of equivalents of the alkaline earth metal moiety to the number of equivalents of the acid moiety is greater than one, and is usually greater than 1.2 and may be as high as 4.5 or greater. In contrast, the equivalent ratio of alkaline earth metal moiety to acid moiety in "normal" alkaline earth metal hydrocarbyl-substituted salts is one, and in "low based" salts is less than one. Thus, the overbased material usually contains greater than 20% in excess of the alkaline earth metal present in the corresponding normal material. For this reason overbased alkaline earth metal hydrocarbyl-substituted salts have a greater capability for neutralising acidic matter than do the corresponding normal alkaline earth metal hydrocarbyl-substituted salts, though not necessarily an increased detergency power. It is with the normal or low based salts that the present invention is concerned.

The prior art teaches many methods for preparing normal or low-based metal hydrocarbyl-substituted salts. One such method comprises reacting a hydrocarbyl-substituted acid, in the presence or absence of sulphur, lubricating oil, a metal hydroxide (in an equivalent ratio of the alkaline earth metal moiety to the acid moiety of up to 1) followed by a heading distillation (to remove unreacted hydroxylic compound) and filtration.

Phenols, sulphonic acids, naphthenic acids and salicylic acids are relatively expensive materials. We have found that normal or low based detergents having improved performance result when a proportion of the phenols, sulphonic acids, naphthenic acids and salicyclic acids used in the preparation of individual or mixed, sulphurised or sulphur-free salts is replaced by defined amounts of certain comparatively cheaper carboxylic acids or derivatives thereof. Moreover, the aforesaid low based detergents may be produced in a similar manner using a pre-formed salt as a proportion of the starting material.

The use of organic carboxylic acids in the production of alkaline earth metal hydrocarbyl-substituted salts is not new. Thus, U.S. Pat. No. 4,328,111 discloses the reaction product of a basic compound comprising an overbased metal sulphonate, phenate, or mixtures, thereof, with acidic compounds comprising organic carboxylic acids comprising about 1 to about 100 carbon atoms or an organic carboxylic acid anhydride comprising about 4 to about 100 carbon atoms, or a mixture thereof. However, it is stated that not all organic carboxylic acids or anhydrides or mixtures thereof improve the properties of the resulting salt. Generally, it is stated to be preferable to react the basic compound with the acidic compound after overbasing is complete, though it is possible to react the acidic compound with intermediate overbased materials. Nevertheless, the acidic compound is always reacted with an overbased basic compound.

Accordingly the present invention provides a process for the production of a lubricating oil additive concentrate which process comprises reacting at elevated temperature component (A) at least one compound or sulphurised derivative thereof, said compound being (i) a hydrocarbyl-substituted phenol, (ii) a hydrocarbyl-substituted sulphonic acid, (iii) a hydrocarbyl-substituted salicylic acid, or (iv) a hydrocarbyl-substituted naphthenic acid, component (B) a calcium base added either in a single addition or in a plurality of additions at intermediate points during the reaction, component (C) at least one compound which is (i) water, (ii) a polyhydric alcohol having 2 to 4 carbon atoms, (iii) a di-($C_3$ or $C_4$) glycol, (iv) a tri-($C_2$–$C_4$) glycol, (v) a mono- or poly-alkylene glycol alkyl ether of the formula (I)

$$R(OR^1)_xOR^2 \qquad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, component (D) a lubricating oil, component (E) at least one compound which is (i) a carboxylic acid or an acid anhydride, acid chloride or ester thereof, said acid having the formula (II)

$$R^3-\underset{\underset{R^4}{|}}{CH}-COOH \qquad (II)$$

wherein $R^3$ is a $C_{10}$ to $C_{24}$ alkyl or alkenyl group and $R^4$ is hydrogen, a $C_1$ to $C_4$ alkyl group or a $CH_2COOH$ group, or (ii) a di- or poly-carboxylic acid containing from 36 to 100 carbon atoms or an acid anhydride, acid chloride or ester thereof, in an amount up to 60% by weight of the total weight of component (A) and component (E), said total weight of component (A) and component (E) being that required to satisfy an equivalent ratio of component (B) to component (A) plus component (E) of not greater than one.

Component (A) is a hydrocarbyl-substituted phenol, sulphonic acid, salicylic acid or napthenic acid or mixtures thereof. In addition a proportion of the acid as component (A) may be replaced by a pre-formed salt of any of the aforementioned acids, preferably a calcium salt. The aforementioned acids and/or salts may be sulphurised. Alternatively component (A) may comprise a non-sulphurised acid and/or salt, and a source of sulphur, for example elemental sulphur, a sulphur monohalide or a sulphur dihalide.

The hydrocarbyl substituent of the aforementioned hydrocarbyl-substituted salts and acids and their sulphurised derivatives may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl, radicals derived from the polymerisation of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is either propene, 1-butene or isobutene.

Component (B) is a calcium base. The calcium may be added for example in the form of quick lime (CaO) or in the form of slaked lime ($Ca(OH)_2$).

Component (B) may be added in whole to the initial reactants, or in part to the initial reactants and the remainder in one or more portions at a subsequent stage or stages in the process. It is preferred that component (B) is added in a single addition.

As component (C) there may be used one or more polar organic compounds or water, or mixtures thereof; preferably a polar organic compound.

Suitable compounds having the formula (I) include the monomethyl or dimethyl ethers of (a) ethylene glycol, (b) diethylene glycol, (c) triethylene glycol or (d) tetraethylene glycol. A particularly suitable compound is methyl diglycol ($CH_3OCH_2CH_2OCH_2CH_2OH$). Mixtures of glycol ethers of formula (I) and glycols may also be empolyed. Using a glycol ether of formula (I) or a glycol as component (C) it is preferred to use in combination therewith an inorganic halide, for example ammonium chloride, and a lower, i.e. $C_1$ to $C_4$, carboxylic acid, for example acetic acid. The polyhydric alcohol may suitably be either a dihydric alcohol, for example ethylene glycol or propylene glycol, or a trihydric alcohol, for example glycerol. The di- ($C_3$ or $C_4$) glycol may suitably be dipropylene glycol, the tri- ($C_2$ to $C_4$) glycol may suitably be triethylene glycol. Preferably the component (C) is either ethylene glycol or methyl diglycol, the latter in combination with ammonium chloride and acetic acid.

Component (C), may also suitably be a $C_1$ to $C_{20}$ monohydric alcohol, a $C_1$ to $C_{20}$ ketone, a $C_1$ to $C_{10}$ carboxylic acid ester or a $C_1$ to $C_{20}$ ether which may be aliphatic, alicyclic or aromatic. Examples are methanol, acetone, 2-ethyl hexanol, cyclohexanol, cyclohexanone, benzyl alcohol, ethyl acetate and acetophenone, preferably 2-ethyl hexanol. In the preferred method of producing the concentrate of the present invention, there may be used in combination (i) component (C) as defined above and (ii) a solvent.

As the solvent (ii) there may suitably be used an inert hydrocarbon, which may be aliphatic or aromatic. Examples of suitable solvents (ii) include toluene, xylene, naphtha and aliphatic paraffins, for example hexane, and cycloaliphatic paraffins.

A particularly preferred combination of (i) and (ii) is methanol and toluene. An advantage of using a combination of (i) and (ii) is that the use of ethylene glycol can be avoided. Residual ethylene glycol in the lubricating oil additive may result in corrosion of an engine in which the concentrate is used.

Component (D) is a lubricating oil. The lubricating oil is suitably an animal, vegetable or mineral oil. Suitably the lubricating oil is a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tri-decyladipate, or polymeric hydrocarbon lubricating oils, for example liquid polyisobutenes and poly-alpha olefins. The lubricating oil may suitably comprise from 10 to 90%, preferably from 10 to 70%, by weight of the concentrate.

Component (E) is either (i) a carboxylic acid of formula (II), or (ii) a di- or polycarboxylic acid containing from 36 to 100 carbon atoms, or an acid anhydride, an acid chloride or ester of (i) or (ii). As regards (i), this is a carboxylic acid having the formula (II) or an acid anhydride, acid chloride or ester thereof. Preferably $R^3$ is an unbranched alkyl or alkenyl group. Preferred acids of formula (II) are those wherein $R^4$ is hydrogen and $R^3$ is a $C_{10}$ to $C_{24}$, more preferably $C_{18}$ to $C_{24}$ unbranched alkyl group. Examples of suitable saturated carboxylic acids of formula (II) include capric, lauric, myristic, palmitic, stearic, isostearic, arachidic, behenic and lignoceric acids. Examples of suitable unsaturated acids of formula (II) include lauroleic, myristoleic, palmitoleic, oleic, gadoleic, erucic, ricinoleic, linoleic and linolenic acids. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example tall, cotton, ground nut, coconut, linseed, palm kernel, olive, corn, palm, castor, soyabean, sunflower, herring and sardine oils and tallow. Sulphurised acids and acid mixtures may also be employed. Instead of, or in addition to, the carboxylic acid there may be used the acid anhydride, the acid chloride or the ester derivatives of the acid, preferably the acid anhydride. It is preferred however to use a carboxylic acid or a mixture of carboxylic acids. A preferred carboxylic acid of formula (II) is stearic acid.

Instead of, or in addition to (i), component (F) may be (ii) a di- or polycarboxylic acid containing from 36 to 100 carbon atoms or an acid anhydride, acid chloride or ester derivative thereof, preferably an acid anhydride thereof; (ii) is preferably a polyisobutene succinic acid or a polyisobutene succinic anhydride.

Component (E) is used to replace a proportion of component (A) in concentrates comprising normal or low-based salts i.e. where the stoichiometric equivalent ratio of (B) to (A) is not greater than about 1.8 Up to 60% by weight of component (A) can be replaced by component (E) according to the present invention.

Suitably the concentrate may have a viscosity measured at 100° C. of less than 1000 cSt, preferably less than 750 cSt, more preferably less than 500 cSt.

Preferably the reaction is carried out in the presence of component (G). As component (G) there may be used (i) an inorganic halide which may suitably be either a hydrogen, an ammonium or a metal halide. Suitably the metal moiety of the metal halide may be zinc, aluminium or an alkaline earth metal, preferably calcium. Of the halides, the chloride is preferred. Suitable chlorides include hydrogen chloride, calcium chloride, ammonium chloride, aluminium chloride and zinc chloride, preferably calcium chloride. Alternatively, component (G) may be (ii) an ammonium alkanoate or a mono-, di-, tri- or tetra-alkyl ammonium formate or alkanoate, preferably an ammonium alkanoate, more preferably ammonium acetate.

Mixtures of (i) and (ii) may be used. However, when component (G) is (ii) above, component (E) is not an acid chloride.

Suitably the amount of component (G) employed may be up to 2.0% by weight based on the weight of the concentrate.

Typically, the amount of component (F) incorporated is 10% to 35%, more preferably 12 to 20%, for example about 16% by weight based on the weight of the concentrate.

Suitably the amount of total alkaline earth metal present in the concentrate is 10 to 20% by weight based on the weight of the concentrate.

The alkaline earth metal hydrocarbyl-substituted salt and/or acid in the final product may be either sulphurised or non-sulphurised, preferably non-sulphurised. Where they are sulphurised, sulphur may be present in the concentrate in an amount of from 1 to 6%, preferably from 1.5 to 3% by weight based on the weight of the concentrate.

The addition of carbon dioxide is optional, though it is preferred that it is not added. If carbon dioxide is added, it is preferably added after the addition of component (B).

The carbon dioxide may be added in the form of a gas or a solid, preferably in the form of a gas. In gaseous form it may suitably be blown through the reaction mixture.

Suitably carbon dioxide in a combined form may be present in the concentrate in an amount in the range from 5 to 20, preferably from 9 to 15% by weight based on the weight of the concentrate.

Preferably the TBN of the concentrate is from 0 to 200.

Suitably the reaction of components (A)–(E) and also the carbonation reaction (if any) may be carried out from 15 to 200, preferably 60° to 150° C., though the actual temperatures chosen for various stages of the reaction may differ if desired. The pressure may be atmospheric, subatmospheric or superatmospheric.

The concentrate may be recovered by conventional means, for example by distillative stripping of component (C), or the solvent (if any).

Finally, it is preferred to filter the concentrate so-obtained.

Alternatively, the concentrate can be centrifuged.

A final aspect of the present invention provides a finished lubricating oil composition which composition comprises a lubricating oil and a lubricating oil additive concentrate prepared as hereinbefore described, The finished lubricating oil composition may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the concentrate composition.

In addition to their use as additives for incorporation into lubricating oil compositions, the additive concentrates of the present invention may also find application as fuel additives.

The invention will now be further illustrated by reference to the following Examples. In all the Examples the term "TBN" (Total Base Number) is used. TBN is expressed in mg KOH/g as measured by the method of ASTM D2896. In the examples where lime is used, it is in the form of slaked lime $Ca(OH)_2$. Viscosities were measured by the method of ASTM-D445.

Comparison Test 1 (CTI) (Conventional low based sulphonate preparation)

| Charge | |
|---|---|
| SA157 (A hydrocarbyl-substituted, sulphonic acid 66% active, MW = 480, commercially available from Paramins). | 270 g |
| Lubricating oil (SN 100) | 140 g |
| Calcium chloride | 1.0 g |

Method (a) Lime (25 g) was added at 120° C./700 mmHg.
(b) Ethylene Elycol (70 g) was added at 145°–165° C./700 mmHg.
(c) The mixture was held at 165° C. 1 hour.
(d) The mixture was stripped at 200° C./10 mmHg over 1 hour.
(e) The product was filtered.

Product Weights

Crude product—466 g
Distillate—36 g carboxylic

| Product Composition after Filtration | |
|---|---|
| Ca | 2.89% w/w |
| S | 2.94% w/w |
| Ca as sulphonate | 2.02% w/w |
| TBN | 25 mg KOH/G |
| $V_{100}$ | 145 cSt |
| Carboxylic acid | 0 |

This is not an example according to the present invention because no carboxylic acid was used in the preparation.

EXAMPLE 1

| Charge | |
|---|---|
| SA 157 | 219.6 g |
| Stearic acid (95%) pure) | 21.9 g |
| Lubricating oil (SN 100) | 181 g |
| Calcium chloride | 1.3 g |

Method (a) Lime (25.4 g) was added at 120° C./700 mmHg.
(b) Ethylene glycol (71.7 g) was added at 145° C.–165° C./700 mmHg.
(c) The mixture was held at 165° C. for 1 hour.
(d) The mixture was stripped at 200° C/.10 mmHg over 1 hour.
(e) The product was filtered.

Product Weights

Crude product—325 g (some losses during stripping)
Distillate—145 g

| Product Composition after Filtration | |
|---|---|
| Ca | 3.7% w/w |
| S | 3.2% w/w |

-continued

| Product Composition after Filtration | |
|---|---|
| Ca as sulphonate | 2.2% w/w |
| TBN | 53 mg KOH/g |
| $V_{100}$ | 58.7 cSt |
| $V_{40}$ | 1008 cSt |
| VI | 113 |
| Stearic acid | 5% w/w |

EXAMPLE 2

| Charge | |
|---|---|
| SA 157 | 167.7 g |
| Stearic acid (95%) pure) | 44.6 g |
| Lubricating oil (SN 100) | 216 g |
| Calcium chloride | 1.4 g |

Method (a) Lime (25.9 g) was added at 120° C./700 mmHg.

(b) Ethylene glycol (75 g) was added at 145° C.–165° C./700 mmHg.

(c) The mixture was held at 165° C. for 1 hour.

(d) The mixture was stripped at 200° C./10 mmHg over 1 hour.

(e) The product was filtered.

Product Weights

Crude product—450 carboxylic

Distillate—80.6 g

| Product Composition after Filtration | |
|---|---|
| Ca | 2.82% w/w |
| S | 1.96% w/w |
| Ca as sulphonate | 1.4% w/w |
| TBN | 56 mg KOH/g |
| $V_{100}$ | 25.8 cSt |
| $V_{40}$ | 243 cSt |
| VI | 136 |
| Stearic acid | 9.91% w/w |

EXAMPLE 3

| Charge | |
|---|---|
| SA 157 | 118.1 g |
| Stearic acid (95%) pure) | 70.7 g |
| Lubricating oil (SN 100) | 265 g |
| Calcium chloride | 1.4 g |

Method (a) Lime (27.4 g) was added at 120° C./700 mmHg.

(b) Ethylene glycol (79.4 g) was added at 145° C.–165° C./700 mmHg.

(c) The mixture was held at 165° C. for 1 hour.

(d) The mixture was stripped at 200° C./10 mmHg over 1 hour.

(e) The product was filtered.

Product Weights

Crude product—454 g

Distillate—94.7 g

| Product Composition after Filtration | |
|---|---|
| Ca | 2.94% w/w |
| S | 1.54% w/w |
| Ca as sulphonate | 0.91% w/w |
| TBN | 62 mg KOH/g |
| $V_{100}$ | 56.6 cSt |

-continued

| Product Composition after Filtration | |
|---|---|
| $V_{40}$ | 481.6 cSt |
| VI | 186 |
| Stearic acid | 15.57% w/w |

EXAMPLE 4

| Charge | |
|---|---|
| SA 157 | 167.7 g |
| Stearic acid (70%) pure) | 44.6 g |
| Lubricating oil (SN 100) | 216 g |
| Calcium chloride | 1.4 g |

Method (a) Lime (25.9 g) was added at 120° C./700 mmHg.

(b) Ethylene glycol (15.0 g) was added at 145° C.–165° C./700 mmHg.

(c) The mixture was held at 165° C. for 1 hour.

(d) The mixture was stripped at 200° C./10 mmHg over 1 hour.

(e) The product was filtered.

Product Weights

Crude product—415.3 g

Distillate—71.0 g

| Product Composition after Filtration | |
|---|---|
| Ca | 3.08% w/w |
| S | 2.23% w/w |
| Ca as sulphonate | 1.4% w/w |
| TBN | 54 mg KOH/g |
| $V_{100}$ | 21.3 cSt |
| $V_{40}$ | 187.2 cSt |
| VI | 135 |
| Stearic acid | 10.74% w/w |

EXAMPLE 5

| Charge | |
|---|---|
| SA 157 | 220 g |
| Pre-sulphurised rape top fatty acid | 25 g |
| Lubricating oil (SN 100) | 181 g |
| Calcium chloride | 2.0 g |

Method (a) Lime (25.4 g) was added at 1200° C./700 mmHg.

(b) Ethylene glycol (72.0 g) was added at 145° C.–165° C./700 mmHg, (c) The mixture was held at 165° C. for 1 hour.

(d) The mixture was stripped at 200° C./10 mmHg over 1 hour.

(e) The product was filtered.

Product Weights

Crude product—446.1 g

Distillate—85.3 g

| Product Composition after Filtration | |
|---|---|
| Ca | 3.13% w/w |
| S | 3.33% w/w |
| Ca as sulphonate | 1.87% w/w |
| TBN | 44.8 mg KOH/g |
| $V_{100}$ | 54.1 cSt |
| $V_{40}$ | 809 cSt |
| VI | 122 |

-continued

| Product Composition after Filtration | |
|---|---|
| Sulphurised fatty acid | 5.6% w/w |

EXAMPLE 6

| Charge | |
|---|---|
| SA 157 | 226.6 g |
| Rape top fatty acid | 23.0 g |
| Lubricating oil (SN 100) | 175 g |
| Calcium chloride | 2.0 g |

Method (a) Lime (26 g) was added at 120° C./700 mmHg.

(b) Ethylene glycol (74.0 g) was added at 145° C.–165° C./700 mmHg.

(c) The mixture was held at 165° C. for 1 hour.

(d) The mixture was stripped at 200° C./10 mmHg over 1 hour.

(e) The product was filtered.

Product Weights

Crude product—359 g (losses during stripping)

Distillate—138.5 g

| Product Composition after Filtration | |
|---|---|
| Ca | 2.42% w/w |
| S | 3.91% w/w |
| Ca as sulphonate | 2.2% w/w |
| TBN | 47.2 mg KOH/g |
| $V_{100}$ | 48.3 cst |
| $V_{40}$ | 1220 cSt |
| VI | 79.5 g |
| Rape Top Fatty Acid | 6.41% w/w |

EXAMPLE 7

| Charge | |
|---|---|
| SA 157 | 171 g |
| Rape top fatty acid | 45 g |
| Lubricating oil (SN 100) | 204 g |
| Calcium chloride | 10.3 g |

Method (a) Lime (26 g) was added at 120° C./700 mmHg.

(b) Ethylene glycol (74 g) was added at 145° C.–165° C./700 mmHg.

(c) The mixture was held at 165° C. for 1 hour.

(d) The mixture was stripped at 200° C./10 mmHg over 1 hour.

(e) The product was filtered.

Product Weights

Not determined

| Product Composition after Filtration | |
|---|---|
| Ca | = 3.1% w/w |
| S | = 3.08% w/w |
| Ca as sulphonate | = 1.4% w/w |
| TBN | = 47 mg KOH/g |
| $V_{100}$ | = 27.9 cSt |
| $V_{40}$ | = 322 cSt |
| VI | = 117 |

EXAMPLE 8

| Charge | |
|---|---|
| SA 157 | = 176 g |
| ADX 100 ($C_{12}$-alkylphenol, commercially available from Adibis). | = 14.1 g |
| Rape top fatty acid | = 32.5 g |
| Lubricating oil (SN 100) | = 205 g |
| Sulphur | = 10.5 g |
| Calcium chloride | = 2.6 g |

Method (a) Lime (26 g) was added at 120° C./700 mmHg.

(b) Ethylene glycol (74.9 g) was added at 145° C.–165° C./700 mmHg.

(c) The mixture was held at 165° C. for 1 hour.

(d) The mixture was stripped at 200° C./10 mmHg over 1 hour.

(e) The product was filtered.

Product Weights

Crude product—402 g

Distillate—105 g

| Product Composition after Filtration | |
|---|---|
| Ca | = 3.14% w/w |
| S | = 2.87% w/w |
| Ca as sulphonate | = 1.56% w/w |
| TBN | = 54.2 mg KOH/g |
| $V_{100}$ | = 36.8 cSt |
| $V_{40}$ | = 588.8 cSt |
| VI | = 98 |
| Rape top fatty acid | = 8.08% w/w |
| $C_{12}$ alkylphenol | = 3.51% w/w |

Comparison Test 2 (Conventional low based phenate preparation)

| Charge | |
|---|---|
| ADX 100 | = 203 g |
| Lubricating oil (SN 100) | = 183 g |
| Sulphur | = 32 g |
| Calcium chloride | = 5 g |

Method (a) Lime (22 g) was added at 120° C./700 mmHg.

(b) Ethylene glycol (50 g) was added at 145° C.–165° C./700 mmHg.

(c) The mixture was held at 165° C. for 1 hour.

(d) The mixture was stripped at 200° C./10 mmHg over a period of one hour.

(e) The product was filtered.

Product Weights

Crude product—403.4 g

Distillate—66.3 g

| Product Composition after Filtration | |
|---|---|
| Ca | = 3.08% w/w |
| S | = 4.3% w/w |
| TBN | = 71 mg KOH/g |
| $V_{100}$ | = 31.9 cSt |
| $V_{40}$ | = 692 cSt |
| VI | = 67 |
| Carboxylic acid | = 0% w/w |

EXAMPLE 9

| Charge | |
|---|---|
| ADX 100 | = 163 g |
| Stearic acid (70% pure) | = 40 g |
| Lubricating oil (SN 100) | = 183 g |
| Sulphur | = 26 g |
| Calcium chloride | = 5 g |

Method (a) Lime (22 g) was added at 120° C./700 mmHg.

(b) Ethylene glycol (50 g) was added at 145° C.–165° C./700 mmHg.

(c) The mixture was held at 165° C. for 1 hour.

(d) The mixture was stripped at 200° C./10 mmHg over a period of one hour.

(e) The product was filtered.

Product Weights.

Crude product—415.3 g

Distillate—69.2 g

| Product Composition after Filtration | |
|---|---|
| Ca | = 2.99% w/w |
| S | = 3.71% w/w |
| TBN | = 74.5 mg KOH/g |
| $V_{100}$ | = 30.9 cSt |
| $V_{40}$ | = 491.8 cSt |
| VI | = 92 |
| Stearic acid | = 9.63% w/w |

EXAMPLE 10

| Charge | |
|---|---|
| ADX 100 | = 123.6 g |
| Stearic acid (70% pure) | = 81.0 g |
| Lubricating oil (SN 100) | = 185.4 g |
| Sulphur | = 19.7 g |
| Calcium chloride | = 5.1 g |

Method (a) Lime (22 g) was added at 120° C./700 mmHg.

(b) Ethylene glycol (50 g) was added at 145° C.–165° C./700 mmHg.

(c) The mixture was held at 165° C. for 1 hour.

(d) The mixture was stripped at 200° C. 10 mmHg over a period of one hour.

(e) The product was filtered.

Product Weights

Crude product—398.1 g

Distillate—155.5 g

| Product Composition after Filtration | |
|---|---|
| Ca | = 3.14% w/w |
| S | = 2.50% w/w |
| TBN | = 82.6 mg KOH/g |
| $V_{100}$ | = 575 cSt |
| $V_{40}$ | = 10680 cSt |
| VI | = 225 |
| Stearic acid | = 20.3% w/w |

EXAMPLE 11

| Charge | |
|---|---|
| ADX 100 | = 123.6 g |

-continued

| Charge | |
|---|---|
| Stearic acid (70% pure) | = 81.0 g |
| Lubricating oil (SN 100) | = 185.4 g |
| Sulphur | = 19.7 g |
| Calcium chloride | = 5.1 g |

Method (a) Lime (22 g) was added at 120° C./700 mmHg.

(b) Ethylene glycol (50 g) was added at 145° C.–165° C./700 mmHg.

(c) The mixture was held at 165° C. for 1 hour.

(d) The mixture was stripped at 200° C./10 mmHg over a period of one hour.

(e) The product was filtered.

Product Weights

Crude product—409.9 g

Distillate—59.8 g

| Product Composition after Filtration | |
|---|---|
| Ca | = 3.02% w/w |
| S | = 2.65% w/w |
| TBN | = 78 mg KOH/g |
| $V_{100}$ | = 285.5 cSt |
| $V_{40}$ | = 4300 cSt |
| VI | = 205 |
| Stearic acid | = 19.8% w/w |

Example 12

Performance Test Results on Low Based Detergents

1. The low-based detergents of Examples 1 to 3 and 5 to 8 were blended into a test formulation comprising:

3.9% dispersant 2.6% overbased phenate 1.3% zinc dialkyldithiophosphate 0.72% overbased sulphonate 0.01% foam inhibitor 0.15% pour point depressant low-based detergent (added in an amount that contains 10 millimoles of calcium).

Made up to 100% with mixture of SN 1.50 (20%) and SN 500 (80%).

2. The formulations were evaluated in the Roxana Panel Coker Test using a panel temperature of 325° C. over a period of 4 hours.

3. The results are given in the accompanying Table.

Comparison Tests 3 and 4

Example 12 was repeated except that instead of the low-based detergents of the Examples there was used commercially available low-based sulphonates produced in a very similar manner to Comparison Test 1. The results are given in the accompanying Table.

TABLE

| Low-based detergent of Example:- | Deposit wt (mg) |
|---|---|
| Comparison Test 3 | 64 |
| Comparison Test 4 | 100.4 |
| 1 | 58 |
| 2 | 49.2 |
| 3 | 25.2 |
| 5 | 54.8/42.4 |
| 6 | 47.3/61.0 |
| 7 | 47.9/55.3 |
| 8 | 46.9/41.6 |

All the low-based detergents according to the invention gave lower weights of deposits in the Panel Coker Test than the commercial products.

We claim:

1. A process for the production of a lubricating oil additive concentrate which process comprises reacting at elevated temperature in the absence of $CO_2$ component (A) at least one compound or sulphurised derivative thereof, said compound being (i) a hydrocarbyl-substituted phenol, (ii) a hydrocarbyl-substituted sulphonic acid, (iii) a hydrocarbyl-substituted salicylic acid, or (iv) a hydrocarbyl-substituted naphthenic acid, component (B) a calcium base added either in a single addition or in a plurality of additions during the reaction, component (C) at least one compound which is (i) water, (ii) a polyhydric alcohol having 2 to 4 carbon atoms, (iii) a di- ($C_3$ or $C_4$) glycol, (iv) a tri-($C_2$–$C_4$) glycol, (v) a mono-or poly-alkylene glycol ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, component (D) a lubricating oil, component (E) at least one compound which is (i) a carboxylic acid or an acid anhydride, or ester thereof, said acid having the formula (II)

$$R^3-\underset{\underset{R^4}{|}}{CH}-COOH \quad (II)$$

wherein $R^3$ is a $C_{10}$ to $C_{24}$ alkyl or alkenyl group and $R^4$ is hydrogen, a $C_1$ to $C_4$ alkyl group or a $CH_2COOH$ group, or (ii) a di- or poly-carboxylic acid containing from 36 to 100 carbon atoms or an acid anhydride, acid chloride or ester thereof, and component (G) which is at least one compound which is an ammonium alkanoate or a mono-, di-, tri- or tetra-alkyl ammonium formate or alkanoate, said component (E) is present in an amount up to 60% by weight of the total weight of component (A) and component (E), said total weight of component (A) and component (E) being that required to satisfy an equivalent ratio of component (B) to component (A) plus component (E) of not greater than about one.

2. A process as claimed in claim 1 said ammonium alkanoate is ammonium acetate.

3. A process as claimed in claim 1 wherein
component (B) is calcium hydroxide
component (C) is ethylene glycol
component (E) is stearic acid, and
component (G) is ammonium acetate.

4. A process for the production of a lubricating oil additive concentrate as defined in claim 1 wherein component (A) is a sulfurized hydrocarbyl-substituted phenol; component (C) is a polyhydirc alcohol having 2 to 4 carbon atoms or a di-($C_3$ or $C_4$) glycol or a tri-($C_2$–$C_4$) glycol; component (E) has the formula II wherein $R_3$ is a $C_{10}$–$C_{24}$ and $R_4$ is H or $C_1$–$C_4$ alkyl.

* * * * *

UNITED STATES PATENT AND TRADEMARK OFFICE

CERTIFICATE OF CORRECTION

PATENT NO. : 5,437,803

DATED : August 1, 1995

INVENTOR(S) : Charles Cane, John Crawford and Patrick O'Connor

It is certified that error appears in the above-indentified patent and that said Letters Patent is hereby corrected as shown below:

Col. 5, l. 15, should read "component (E)"

Col. 6, l. 23, correct the spelling of the word "glycol"

Col. 6, l. 38, formula should read "25 mg KOH/g"

Col. 7, Example 2, l. 29, should read "450 g"

Col. 8, Example 5, l. 50, change "1200°C." to --120°C.--

Col. 8, l. 52, should read "mmHg."

Col. 11, l. 48, Example 10, should read 200°C./10 mmHg"

Column 12, line 46, claim 2, line 1, should read "claim 1 wherein"

Signed and Sealed this

Twelfth Day of December, 1995

*Attest:*

*Attesting Officer*

Bruce Lehman

BRUCE LEHMAN

*Commissioner of Patents and Trademarks*